US005301924A

United States Patent [19]

Kammerer

[11] Patent Number: 5,301,924

[45] Date of Patent: Apr. 12, 1994

[54] ARROWHEAD PULLER

[76] Inventor: Fred O. Kammerer, Chestnut Dr. - Box 389, Purdys, N.Y. 10578

[21] Appl. No.: 49,090

[22] Filed: Apr. 16, 1993

[51] Int. Cl.[5] ..... B66F 3/00

[52] U.S. Cl. ..... 254/131; 29/267

[58] Field of Search ..... 254/131, 129, 130; 29/267; 81/177.4

[56] References Cited

U.S. PATENT DOCUMENTS

| | | | |
|---|---|---|---|
| 90,559 | 5/1869 | Knott . | |
| 2,629,584 | 2/1953 | Cannon . | |
| 2,889,618 | 2/1957 | Morris et al. . | |
| 2,940,167 | 6/1960 | Boyer et al. . | |
| 3,110,959 | 11/1963 | Blackstone . | |
| 3,274,675 | 9/1966 | Jackson . | |
| 3,441,251 | 4/1969 | Burns | 254/131 |
| 3,747,195 | 7/1973 | Rigsby et al. . | |
| 3,826,471 | 7/1974 | Orton et al. . | |
| 3,873,068 | 3/1975 | Allen . | |
| 4,010,931 | 3/1977 | Wheeler | 254/131 |
| 4,074,411 | 2/1978 | Willard et al. . | |
| 4,194,278 | 3/1980 | Sanders . | |
| 4,266,330 | 5/1981 | Conte . | |
| 4,633,562 | 1/1987 | Ulsh . | |
| 4,920,625 | 5/1990 | Smith . | |
| 5,102,100 | 4/1992 | Troncoso, Jr. . | |
| 5,205,541 | 4/1993 | Roberts et al. | 29/267 |

*Primary Examiner*—Robert C. Watson

*Attorney, Agent, or Firm*—Dressler, Goldsmith, Shore & Milnamow, Ltd.

[57] ABSTRACT

An arrowhead puller for pulling an arrowhead having a threaded shank from a tree or a stump comprises an elongate handle having a working end and a gripping end and having a tapped hole extending therethrough, a bolt having a shank with a threaded portion threaded into the tapped hole and having a head providing a fulcrum, and an end piece having a tapped socket to receive the threaded shank of an arrowhead and being hinged to the handle near the working end so as to permit relative movement of the handle and the socket through a range of relative positions. The tapped hole is about one inch from the working end and at least four inches from the gripping end, whereby the handle turning on the fulcrum functions as a leverage force-multiplying lever.

4 Claims, 1 Drawing Sheet

10
12
14
16
20
22
24
26
30
32
34
36
38
40
42
44
46
48
50
52
54
56
2

ARROWHEAD PULLER

TECHNICAL FIELD OF THE INVENTION

This invention pertains to an arrowhead Puller for pulling an arrowhead from a wooden object, such as a tree, stump, or target support, with a leverage force-multiplying action.

BACKGROUND OF THE INVENTION

In archery and hunting, it is common for an arrow shot at a target to miss the target and for the arrowhead to embed itself in a wooden object, such as a tree, stump, or target support. Even if the shaft and fletching of the arrow are removable from the arrowhead, it can be very difficult to remove the arrowhead from a tree, stump, or target support without damage to the arrowhead.

Various tools for prying, pulling, or extracting an arrowhead from a tree, stump, or target stand have been disclosed in prior patents. Those patents include Burns U.S. Pat. No. 3,441,251, Orton et al. U.S. Pat. No. 3,826,471, Allen U.S. Pat. No. 3,873,068, Sanders U.S. Pat. No. 4,194,278, Ulsh U.S. Pat. No. 4,633,562, Smith U.S. Pat. No. 4,920,625, and Troncoso, Jr., U.S. Pat. No. 5,102,100.

Arrowheads of two types are common, namely field points and broadheads, both of which are exemplified in the Troncoso, Jr., patent noted above. Commonly, an arrowhead of either type has a shank with a threaded portion and a shaft of an arrow has a threaded socket, which is adapted threadedly to receive the threaded portion of the arrowhead shank to connect the shaft and fletching removably to the arrowhead. For purposes of interchangeability, dimensions of the threaded portions of the arrowhead shanks and the threaded sockets have been standardized.

As exemplified in the Sanders, Ulsh, Smith, and Troncoso, Jr., patents noted above, it is known for a prying, pulling, or extracting tool to be removably connectible to the threaded shank of such an arrowhead after the shaft and fletching have been removed.

Other devices of related interest are disclosed in Knott U.S. Pat. No. 90,559, Cannon U.S. Pat. No. 2,629,584, Morris et al. U.S. Pat. No. 2,889,618, Boyer et al. U.S. Pat. No. 2,940,176, Jackson U.S. Pat. No. 3,274,675, Rigsby et al. U.S. Pat. No. 3,747,195, and Conte U.S. Pat. No. 4,266,330.

SUMMARY OF THE INVENTION

This invention provides to an arrowhead puller for pulling an arrowhead from a wooden object, such as a tree, stump, or target stand, with a leverage force-multiplying action. Broadly, the arrowhead puller comprises an elongate handle, a bolt, and an end piece, in a unique combination.

The handle has two ends, which may be conveniently called the working end and the gripping end. Also, the handle has a tapped hole located between the working and gripping ends. The tapped hole is closer to the working end and farther from the gripping end. Preferably, the tapped hole is about one inch from the working end and at least four inches from the gripping end.

The bolt has a shank with a threaded portion, which is threaded into the tapped hole. The bolt has a head, which provides a fulcrum. Preferably, the tapped hole extends through the handle so as to enable the threaded shank of the bolt to be threadedly adjusted to adjust spacing between the head of the bolt and the handle. The fulcrum can be thus adjusted.

The end piece has a tapped socket, which is adapted threadedly to receive the threaded portion of an arrowhead shank. The end piece is hinged to the handle, near the working end, so as to permit relative movement of the handle and the socket through a range of relative positions including relative positions wherein the handle is generally aligned with the tapped socket and relative positions wherein the handle is perpendicular to the tapped socket. Preferably, the range of relative positions includes relative positions wherein the handle defines an acute angle relative to the tapped socket.

Because the tapped hole receiving the bolt is closer to the working end, near which the end piece is hinged to the handle, the arrowhead puller operates with a leverage force-multiplying action.

These and other objects, features, and advantages of this invention are evident from the following description of a preferred embodiment of this invention with reference to the accompanying drawings.

DETAILED DESCRIPTION OF PREFERRED EMBODIMENT

Figures 1, 2, 3:
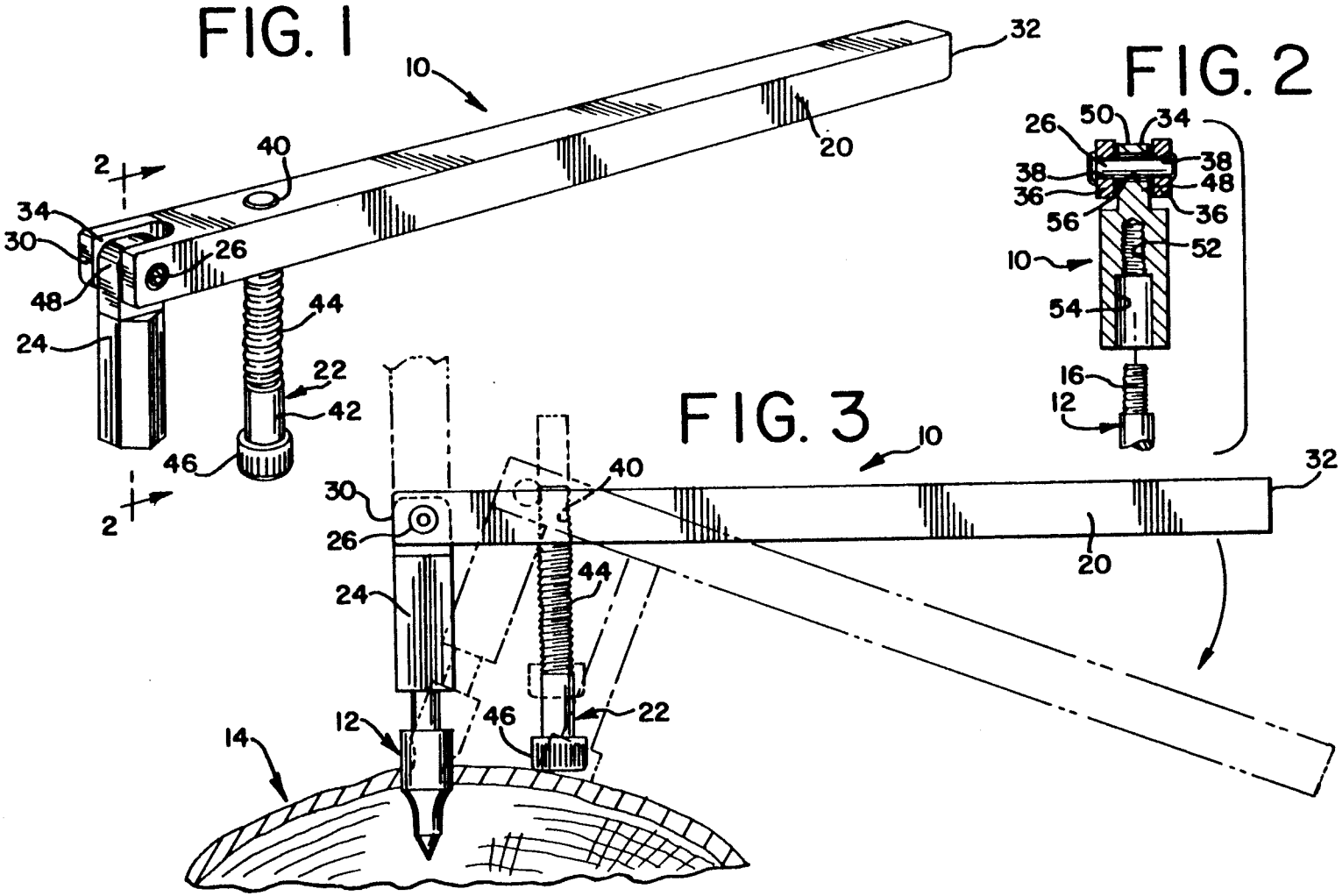
FIG. 1 is a perspective view of an arrowhead puller embodying this invention.
FIG. 2 is a sectional view taken along line 2—2 of FIG. 1, in a direction indicated by arrows. An arrowhead is shown fragmentarily.
FIG. 3 is a plan view of the arrowhead puller being used to pull an arrowhead, such as the arrowhead shown fragmentarily in FIG. 2, from a tree shown in cross-section. Parts of the arrowhead puller are shown in changed positions, in dashed lines, so as to suggest certain movements and possible adjustments.

As shown in the drawings, an arrowhead puller 10 constitutes a preferred embodiment of this invention. The arrowhead puller 10 is designed for pulling an arrowhead 12, which may be a field point as shown in FIGS. 2 and 3, from a wooden object, such as the tree 14 shown in FIG. 3, with a leverage force-multiplying action.

Although a field point is shown as an example, the arrowhead puller 10 can be likewise used with an arrowhead of a different type, such as a broadhead. Whatever type is used, this invention contemplates that the arrowhead 12 has a shank with a threaded portion 16, which conforms to standardized dimensions enabling the threaded portion 16 to be ordinarily threaded into a threaded socket (not shown) so as to connect the shaft and fletching (not shown) removably to the arrowhead 12.

As illustrated and described, the arrowhead puller 10 is assembled from four simple, steel parts, namely an elongate handle 20, a bolt 22, an end piece 24, and a rivet 26.

The handle 20, which is machined from bar stock of rectangular cross-section with an overall length of about five and one-half inches, has a working end 30 and a gripping end 32. The working end 30 is machined so as to have a notch 34 between two end flanges 36, which have aligned holes 38 to accommodate the rivet 26. The handle 20 is provided with a tapped hole 40, which extends through the handle 20. The aligned holes 38 and the tapped hole 40 respectively defines axes lying in mutually orthogonal planes. Preferably, the hole 40 is located about one inch from the working end 30 and about four and one-half inches from the gripping end 32.

The bolt 22 is a conventional bolt having an overall length of about two inches. The bolt 22 has a shank 42 with a threaded portion 44, which is threaded into the tapped hole 40. The threaded portion 44 of the shank 42 can be threadedly adjusted so as to adjust spacing between the head 46 and the handle 20. The bolt 22 has a head 46, which provides a fulcrum.

The end piece 24 is machined from bar stock defining an axis and having a hexagonal cross-section so as to have a tenon 48 extending to an inner end 50 thereof and so as to have a tapped socket 52 extending axially into the end piece 24 from an outer, coaxial, cylindrical bore 54.

The tenon 48 has a hole 56 therethrough to accommodate the rivet 26. The tenon 48 fits into the notch 34 at the working end 34 of the handle 20 so as to align the holes 38 and the hole 56. The rivet 26 extends through one of the holes 38, through the hole 56, and through the other hole 38 and is headed so as to hinge the end piece 24 to the handle 20, near the working end 34.

The end piece 24 is hinged to the handle 20, as described above, so as to permit relative movement of the handle 20 and the end piece 24 from relative positions wherein the handle 20 is generally aligned with the threaded portion 16 received by the socket 52, through relative positions wherein the handle 20 (as shown in complete lines in FIG. 3) is generally perpendicular to the threaded portion 16 received by the socket 52, to relative positions wherein the handle 20 defines an acute angle relative thereto. Such movement of the handle 20 relative to the end piece 24 is suggested in dashed lines in FIG. 3.

The tapped socket 52 is adapted threadedly to receive the threaded shank 16 of an arrowhead 12, as shown in FIG. 3, after the shaft and fletching have been unthreaded from the threaded portion 16 of the arrowhead shank.

In a typical situation, in which an arrow has been shot into the tree 14, the shaft and fletching are unthreaded from the threaded portion 16 of the arrowhead shank while the arrowhead 12 remains embedded in the tree 14. Next, the end piece 24 is threaded onto the threaded portion 16 of the arrowhead shank, whereby that the threaded portion 16 is threaded into the tapped socket 52.

As shown in dashed lines in FIG. 3, the handle 20 can be generally aligned with the end piece 24 so as to facilitate threading the end piece 24 onto the threaded shank 16. Thereupon, the handle 20 is pivoted to a position wherein the handle 20 defines a right angle relative to the end piece 24 or an acute angle relative thereto.

As shown in dashed lines in FIG. 3, the bolt 22 is adjusted threadedly in the tapped hole 40 so that the fulcrum provided by the head 46 positions the handle 20 at a suitable angle, which may range from about 90° to about 60° relative to the threaded shank 16 of the arrowhead 12 when the head 46 bears against the tree 14. Usually, the bolt 22 can be so adjusted between the thumb and forefinger of a user, without using a separate tool.

Thereupon, with the head 46 bearing against the tree 14 and with the handle 20 serving as a leverage force-multiplying lever, the gripping end 32 of the handle 20 is pressed toward the tree 14 so as to pull the arrowhead 12 from the tree 14.

Various modifications may be made in the preferred embodiment described above without departing from the scope and spirit of this invention.

I claim:

1. An arrowhead puller for pulling an arrowhead having a threaded shank from a wooden object with a leverage force-multiplying action, the arrowhead puller comprising (a) an elongate handle having a working end and a gripping end, the handle having a tapped hole located between the working and gripping ends, the tapped hole being closer to the working end and farther from the gripping end, (b) a bolt having a shank with a threaded portion threaded into the tapped hole, the bolt having a head providing a fulcrum, and (c) an end piece having a tapped socket adapted threadedly to receive the threaded shank of an arrowhead, the end piece being hinged to the handle, near the working end, so as to permit relative movement of the handle and the end piece through a range of relative positions including relative positions wherein the handle is generally aligned with the tapped socket and relative positions wherein the handle is perpendicular to the tapped socket.

2. The arrowhead puller of claim 1 wherein the range of relative positions includes relative positions wherein the handle defines an acute angle relative to the tapped socket.

3. The arrowhead puller of claim 1 wherein the tapped hole extends through the handle so as to enable the threaded shank of the bolt to be threadedly adjusted to adjust spacing between the head of the bolt and the handle.

4. The arrowhead puller of claim 1 wherein the tapped hole is about one inch from the working end and at least four inches from the gripping end.

* * * * *